US008746756B2

(12) United States Patent
Tezak et al.

(10) Patent No.: US 8,746,756 B2
(45) Date of Patent: Jun. 10, 2014

(54) VEHICLE DOOR SWITCH ACTUATION SYSTEM

(75) Inventors: Robert J. Tezak, Carol Stream, IL (US); James E. Brown, Naperville, IL (US); Nicholas J. Scholtes, Shorewood, IL (US)

(73) Assignee: Control Solutions LLC, Aurora, IL (US)

( * ) Notice: Subject to any disclaimer, the term of this patent is extended or adjusted under 35 U.S.C. 154(b) by 1100 days.

(21) Appl. No.: 12/638,818

(22) Filed: Dec. 15, 2009

(65) Prior Publication Data

US 2011/0144868 A1 Jun. 16, 2011

(51) Int. Cl.
*E05C 3/06* (2006.01)
*E05B 3/00* (2006.01)

(52) U.S. Cl.
USPC ..... 292/216; 292/48; 292/201; 292/336.3; 292/DIG. 23; 49/280

(58) Field of Classification Search
USPC ..... 49/279–281, 300, 449; 292/1–3, 11, 13, 292/21, 24–26, 29, 30, 44–48, 52, 53, 194, 292/195, 196, 200, 219–223, 226, 227, 229, 292/201, 216, DIG. 3, DIG. 23, DIG. 24, 292/DIG. 25, DIG. 46, DIG. 65, 336.3; 70/92, 465
See application file for complete search history.

(56) References Cited

U.S. PATENT DOCUMENTS 2,366,391 A * 1/1945 Dodge, Jr. ..... 70/264
2,460,961 A * 2/1949 Wilson ..... 292/48
2,922,672 A * 1/1960 Van Voorhees ..... 292/11
3,374,021 A * 3/1968 Gulette ..... 292/336.3
4,641,865 A * 2/1987 Pastva ..... 292/5
4,644,693 A * 2/1987 Wang ..... 49/280
4,917,412 A * 4/1990 Swan et al. ..... 292/48
5,605,363 A * 2/1997 Kapes ..... 292/196
5,708,338 A * 1/1998 Cook et al. ..... 318/466
5,718,465 A * 2/1998 Dowling et al. ..... 292/216
6,101,764 A * 8/2000 Guy-Paul ..... 49/395
6,135,513 A * 10/2000 Hamada et al. ..... 292/201
6,332,634 B1 * 12/2001 Fukumoto et al. ..... 292/201
6,701,671 B1 * 3/2004 Fukumoto et al. ..... 49/280
6,722,714 B2 * 4/2004 Ooe et al. ..... 292/216
6,739,646 B2 * 5/2004 Suzuki et al. ..... 296/155
6,802,543 B1 * 10/2004 Wakefield ..... 292/48
7,434,854 B2 * 10/2008 Fujimatsu et al. ..... 292/336.3
7,441,816 B2 * 10/2008 Watanabe et al. ..... 292/216
8,465,062 B2 * 6/2013 Weinerman et al. ..... 292/137
2001/0005959 A1 * 7/2001 Ooe et al. ..... 49/280
2002/0056232 A1 * 5/2002 Choi ..... 49/280
2005/0099017 A1 * 5/2005 Yoneyama et al. ..... 292/216
2008/0001412 A1 * 1/2008 Nozawa et al. ..... 292/2
2009/0267354 A1 * 10/2009 Donaldson et al. ..... 292/2

* cited by examiner

*Primary Examiner* — Carlos Lugo
*Assistant Examiner* — Alyson M Merlino
(74) *Attorney, Agent, or Firm* — McCracken & Frank LLC

(57) ABSTRACT

A vehicle door switch actuation system is provided. The system includes an exterior handle mechanically coupled with a rotatable shaft. The shaft is mechanically coupled with a door latch. Rotation of the exterior handle to an open door position moves the door latch to release a vehicle door. A first arm and a second arm are mounted to the shaft. The first arm engages a close switch in response to rotation of the exterior handle to a close door position. The second arm engages an open switch in response to rotation of the exterior handle to the open door position.

36 Claims, 10 Drawing Sheets

VEHICLE DOOR SWITCH ACTUATION SYSTEM

FIELD OF THE INVENTION

This invention relates to systems for opening and closing a vehicle door and in particular systems for actuating a vehicle door both mechanically and electronically.

BACKGROUND

In conventional vehicle door actuation systems, a user may open a door through a mechanical operation. For example, an exterior handle may be used to rotate a shaft connected to a rotatable arm. In such mechanical systems, the rotatable arm may be mounted to a rod that is used to move a door latch, which engages a door opening mechanism to open the door.

Where vehicle doors are particularly heavy and cumbersome, users may have a difficult time opening and closing the door. Vehicle doors on certain military or security vehicles, for instance, often require heavy, armored plates on the outer surface of the vehicle. The sheer weight of the door may make it difficult to push or pull the door open or closed. To address this issue, powered door assist systems may provide assistance to users when opening and closing the door. However, certain conventional mechanical systems may lack the ability to be used in conjunction with powered door assist systems. Certain systems employ a conventional mechanical approach to opening, closing, locking, and unlocking a vehicle door while others use a separate approach for activating a powered door assist system. Thus, there exists a need for a vehicle door actuation system that integrates a mechanical door open/close mechanisms with a vehicle powered door assist system.

SUMMARY

A vehicle door switch actuation system is provided. The system includes an exterior handle mechanically coupled with a rotatable shaft. The shaft is mechanically coupled with a door latch. Rotation of the exterior handle to an open door position moves the door latch in a position to release a vehicle door. A first arm and a second arm are mounted to the shaft. The first arm engages a close switch in response to rotation of the exterior handle to a close door position. The second arm engages an open switch in response to rotation of the exterior handle to the open door position.

DETAILED DESCRIPTION

A vehicle door switch actuation system is described herein. In particular, the vehicle door switch actuation system enables a user to open and close a vehicle door both mechanically and electronically.

As shown herein, the vehicle door switch actuation system is installed on a vehicle door. A vehicle door switch actuation system has an exterior handle that serves to both close and open the vehicle door. The exterior handle is mechanically coupled to a rotatable shaft that passes through the vehicle door. A primary arm, a secondary arm, a tertiary arm, and a lower combat latch are also mounted to the shaft on the interior of the vehicle door. A door latch rod may be attached to the secondary arm, and a door latch may be attached to the door latch rod. The door latch may be adapted to engage the door opening mechanism. The secondary arm may be connected to the tertiary arm enabling them to rotate in unison. One end of a first spring may be connected to the tertiary arm and, the other end of the spring may be connected to the frame of the vehicle door. A second spring may be connected between the primary arm and the secondary arm.

An interior handle may serve to open the door and engage a pair of combat latches. The interior handle may be adapted to open the vehicle door as well as engage the combat latches. The interior handle may be connected to a combat latch rod and an upper combat latch. The combat latch rod may also be connected to a lower combat latch to which a lockout arm may also be secured. The pair of combat latches may be used, for example, on military vehicles in combat situations. The combat latches may be thick pieces of metal that are rotated into place to secure the vehicle door to the vehicle.

A plate may be attached to the interior of the vehicle door to allow the positioning of an open switch, a close switch, and a lockout switch. The open switch may signal the controller of a powered door assist system to initiate an open door operation and provide assistance in opening the door. The close switch may signal the controller to initiate a close door operation and provide assistance in closing the door. The lockout switch may be configured to prevent activation of the controller from the open switch or close switch.

As described below, the primary arm, secondary arm, tertiary arm, and lower combat latch may rotate about the shaft in response to rotation of the exterior handle or movement of the interior handle. The lockout arm, being secured to the lower combat latch, rotates in unison with the lower combat latch. As the arms rotate, they engage and activate the open switch, close switch, or lockout switch. Further, the mechanical operation of the door latch is preserved.

Figure 1:
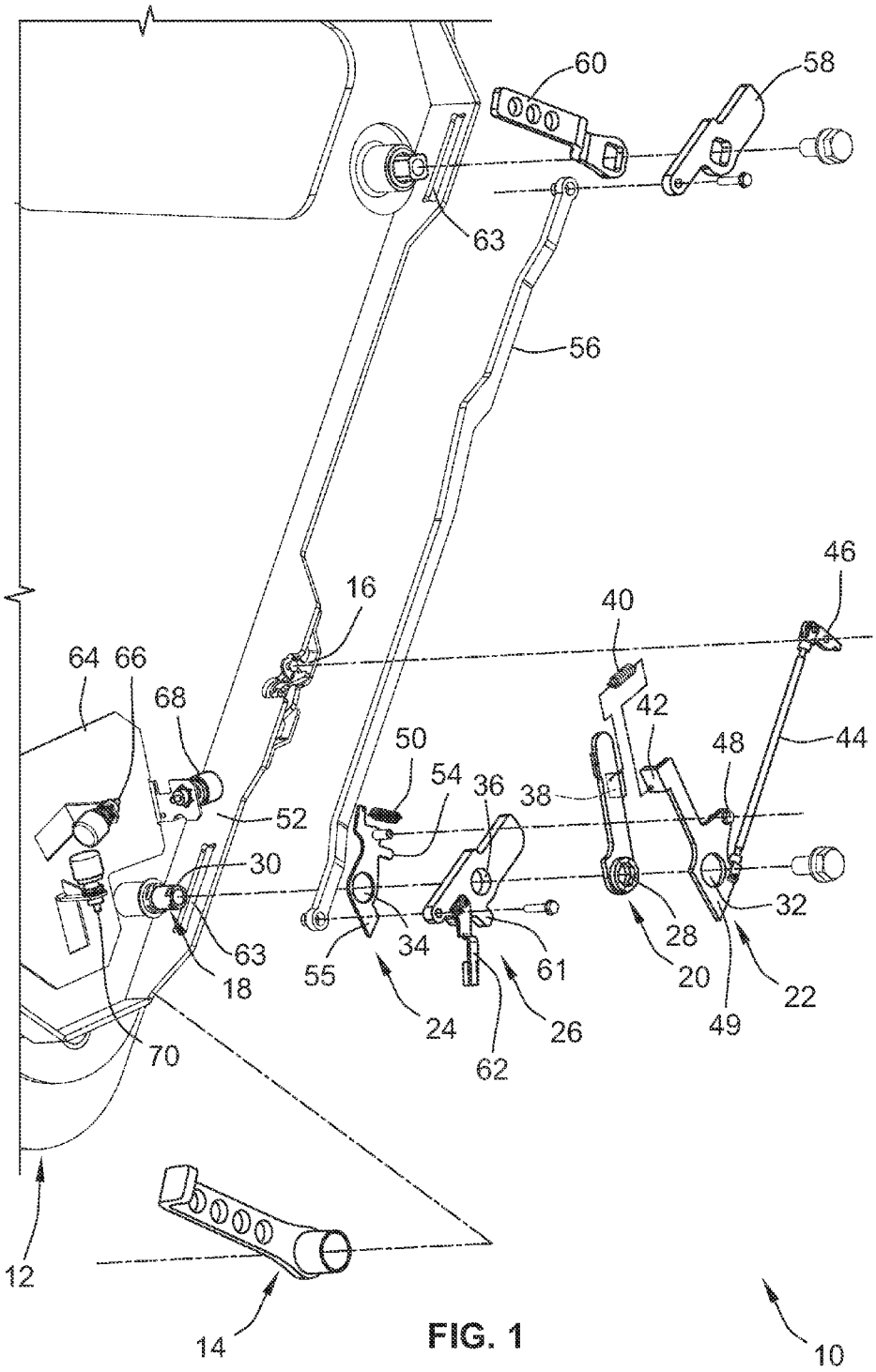
FIG. 1 is an exploded view of an example vehicle door switch actuation system.

Referring to FIG. 1, an exploded view of an example vehicle door switch actuation system 10 is shown. The example vehicle door switch actuation system 10 is installed in a right-side vehicle door 12. An exterior handle 14 is mounted on the exterior of the vehicle door 12. The exterior handle 14, in this example, may be pushed down or pulled up to engage a powered door assist system and mechanically engage the door opening mechanism 16. The exterior handle 12 is also mechanically coulped with a rotatable shaft 18.

The shaft 18 passes through the vehicle door 12 to the interior and rotates in response to rotation of the exterior handle 14. A primary arm 20, secondary arm 22, tertiary arm 24, and a lower combat latch 26 are all mounted to the shaft 18. The primary arm 20, secondary arm 22, tertiary arm 24, and lower combat latch 26 may be made of metal and shaped like those seen in FIG. 1. For example, the primary arm 20 may include a square-shaped hole 28 that meshes with a corresponding square-shaped end 30 of the shaft 18. Additionally, in the example system 10 of FIG. 1, the tertiary arm 24 may be positioned closest to the exterior handle 14 followed by the lower combat latch 26, the primary arm 20, and the secondary arm 22 respectively as shown in FIG. 1.

The secondary arm 22, tertiary arm 24, and lower combat latch 26 may also respectively include a round hole 32, 34, 36 through which the shaft 18 passes. These round holes 32, 34, 36 allow the shaft 18 to rotate without rotating the secondary arm 22, tertiary arm 24, or lower combat latch 26. In the example system 10 of FIG. 1, rotation of the shaft 18 only causes the primary arm 20 to rotate. The shaft 18, for instance, may have a square-shaped end 30 that meshes with a square-shaped hole 28 of the primary arm 20 as mentioned above. Thus, rotating the shaft 18 with the exterior handle 14 only rotates the primary arm 20.

As shown in FIG. 1, the primary arm 20 may be positioned next to the secondary arm 22 in the example system 10. A first spring 40 may be connected between the primary arm 20 and the secondary arm 22. The primary arm 20, for example, may include a finger 38 to which one end of a first spring 40 is attached with the other end of the first spring 40 attached to a finger 42 of the secondary arm 22. The first spring 40 may be a tension spring that may retract when extended.

The first spring 40 connected between the primary arm 20 and secondary arm 22 may return the primary arm to its neutral position when the primary arm rotates independently of the secondary arm. As the primary arm 20 rotates independently of the secondary arm 22, the first spring 40 may extend to a stretched position. When the first spring 40 retracts back to its preloaded state, it may draw back the primary arm 20 in the opposite direction to a neutral position.

As seen in FIG. 1, the secondary arm 22 may be positioned on the interior end of the shaft 18 next to the primary arm 20. As mentioned above, a first spring 40 may be connected between the secondary arm 22 and the primary arm 20. The secondary arm 22, for example, may also include a finger 42 to which one end of a first spring 40 is attached with the corresponding end of the first spring attached to a finger 38 of the primary arm 20. The secondary arm 22 may also be connected to a door latch rod 44, which may, in turn, be connected to a door latch 46 adapted to engage a mechanical door opening mechanism 16. The door latch rod 44 may move up and down as the secondary arm 22 rotates back and forth. This up and down movement of the door latch rod 44 may cause the door latch 46 to move up and down in turn. As the door latch 46 moves down, it may engage the door opening mechanism 16 to release the door 12 and allow it to open.

Also shown in FIG. 1, a bolt 48 may be connected between the secondary arm 22 and the tertiary arm 24. The bolt 48 allows the secondary arm 22 to rotate in unison with the tertiary arm 24 and vice versa. As noted, the example system 10 of FIG. 1 includes a lower combat latch 26 positioned between the secondary arm 22 and tertiary arm 24 with the bolt 48 extending above and across the width of the lower combat latch as shown in FIG. 1. This configuration allows the lower combat latch 26 to push against the bolt 48 causing the secondary arm 22 and tertiary arm 24 to rotate counter-clockwise as the lower combat latch 26 rotates counter-clockwise.

To limit the rotation of the secondary arm 22, the secondary arm may include a heel 49. As the secondary arm rotates counter-clockwise, the heel 49 rotates counter-clockwise towards the frame 52 of the vehicle door 12. The heel 49 may abut the frame 52 of the vehicle door 12 restricting the counter-clockwise rotation of the secondary arm 22.

The tertiary arm 24 may also be positioned closest to the exterior handle 14 in the example system 10 seen in FIG. 1. As noted, a bolt 48 may be connected between the tertiary arm 24 to the secondary arm 22 causing both the tertiary arm and the secondary arm to rotate in unison. Also as noted, this bolt 48 may, for example, extend above and across a lower combat latch 26 positioned between the tertiary arm 24 and secondary arm 22 allowing the lower combat latch to push against the bolt as the combat latch rotates counter-clockwise. The counter-clockwise rotation of the lower combat latch 26 causes the tertiary arm 24 and thus secondary arm 22 to rotate to the counter-clockwise as well.

A second spring 50 may also be connected to the tertiary arm 24 and the frame 52 of the vehicle door 12. The second spring 50 may also be a tension spring that retracts when extended. The second spring 50 ensures that the tertiary arm 24, and thus the secondary arm 22 and primary arm 20, returns to a neutral position from a rotated position. As the tertiary arm 24 rotates counter-clockwise, the second spring 50 may extend to a stretched position. When the second spring 50 retracts back to its preloaded state, it may draw back the tertiary arm 24, secondary arm 22, and primary arm 20 back to a neutral position.

To limit the rotation of the tertiary arm 24, the tertiary arm may include a first heel 54 and a second heel 55. As the tertiary arm 24 rotates clockwise, the first heel 54 rotates clockwise towards the frame 52 of the vehicle door 12. The first heel 54 may abut the frame 52 of the vehicle door 12 restricting the clockwise rotation of the tertiary arm 24. As the tertiary arm 24 rotates counter-clockwise, the second heel 55 rotates counter-clockwise towards the frame 52 of the vehicle door 12. The second heel 55 may similarly abut the frame 52 of the vehicle door 12 restricting the counter-clockwise rotation of the tertiary arm 24.

The lower combat latch 26 seen in the example system 10 of FIG. 1 may also be mounted about the circumference of the shaft 18. Like the secondary arm 22 and tertiary arm 24, a round hole 36 may prevent rotation of the lower combat latch 26 as the shaft 18 rotates. The lower combat latch 26 may also be connected to the combat latch rod 56 as seen in FIG. 1. The combat latch rod 56 is also connected to the upper combat latch 58, which is connected to the interior handle 60 in turn. Thus, rotating the interior handle 60 will rotate the upper combat latch 58. Rotation of the upper combat latch 58 will move the combat latch rod 56 up and down thus rotating the lower combat latch 26 by pushing down and pulling up on the end of the lower combat latch as seen in FIG. 1. Further, a lockout arm 62 is secured to the lower combat latch 26 causing the lockout arm to rotate in conjunction with the lower combat latch.

Further, the upper combat latch 58, may be mounted to an interior end of a rotatable rod that extends through the vehicle door 12 to the exterior of the door. A wrench may be applied to the exterior end of the rod from the outside to rotate the rod and thus turn the interior components of the system. Rotating the rod will rotate the upper combat latch 58, thus moving the combat latch rod 56 to rotate the lower combat latch 26. As described below, this movement may release the vehicle door 12 by engaging the door opening mechanism. Thus, the rod may be used in situations where the electrical system is unresponsive, and the vehicle door 12 must be opened from outside of the vehicle.

To limit the clockwise rotation of the combat latches 26, 58, the frame 52 of the vehicle door 12 may include a corresponding slot 63 into which the combat latches rotate. As the combat latches 26, 58 rotate clockwise into a corresponding slot 63, each latch abuts the bottom of the slot restricting further clockwise rotation. To limit the counter-clockwise rotation of the lower combat latch 26, the lower combat latch may also include a heel 61. As the lower combat latch 26 rotates counter-clockwise, the heel 61 rotates counter-clockwise towards the frame 52 of the vehicle door 12. The heel 61 may abut the frame 52 of the vehicle door 12 restricting the counter-clockwise rotation of the lower combat latch 26.

The switch mounting plate 64 is also shown in the example system 10 of FIG. 1. The switch mounting plate 64 may provide locations at which an open switch 66, a close switch 68, and a lockout switch 70 may be positioned. These switches may be electric switches and connected to a controller 72 (FIG. 2) of a powered door assist system. The powered door assist system may, in turn, utilize a hydraulic cylinder 74 to provide the assistance in opening or closing the vehicle door. For further details on other examples of powered door assist systems, reference may be made to U.S. patent application Ser. No. 12/194,895 filed Aug. 20, 2008 of McKee et al, entitled "Door Assist System and Method of Retrofit Installation of Apparatus" and U.S. patent application Ser. No. 12/194,966 filed Aug. 20, 2008 of McKee et al, entitled "Door Assist System Controller and Method", assigned to the assignee of the subject application, the content of which are hereby incorporated by reference.

Further, the switches may be activated by completing a circuit. When the open switch 66 is activated, the powered door assist system may provide assistance in opening the vehicle door 12. When the close switch 68 is activated, the powered door assist system may provide assistance in closing the vehicle door 12. The lockout switch 70 may be used when the combat latches 26, 58 are engaged to prevent the powered door assist system from initiating an open door or close door operation. When the lockout switch 70 is activated, it may break the circuit between the controller 72 (FIG. 2) of the powered door assist system and the open switch 66 and close switch 68. Thus, if the lockout switch 70 is engaged while the open switch 66 or close switch 68 are engaged, the controller 72 (FIG. 2) will not be activated to provide opening or closing assistance. In another example system, the lockout switch may complete a circuit, and the controller may be programmed to ignore the open switch and close switch if the lockout switch is engaged.

As shown in FIG. 1, the example system 10 may position the open switch 66 to the left of the secondary arm 22, may position the close switch 68 to the right of the primary arm 20, and may position the lockout switch 70 to the left of the lockout arm 26 and beneath the open switch. This arrangement allows the finger 38 of the primary arm 20 to engage the close switch 68 as the primary arm rotates clockwise. This arrangement also allows the finger 42 of the secondary arm 22 to engage the open switch 66 as the secondary arm rotates counter-clockwise. Further, this arrangement allows the lockout arm 24 to engage the lockout switch 70 as the lockout arm rotates clockwise. However, any suitable arrangement of the switches may be employed.

As described further below, the vehicle door switch actuation system may provide four exemplary modes of operation. A first mode of operation allows the door 12 to be opened from outside the vehicle by pushing down on the exterior handle 14. A second mode of operation allows the vehicle door 12 to be closed from outside the vehicle by pulling up on the exterior handle 14. A third mode of operation allows the vehicle door 12 to be opened from inside the vehicle by pulling down on the interior handle 60. A fourth mode of operation allows the combat latches 26, 58 to be engaged by pushing up on the interior handle 60.

Figure 2:
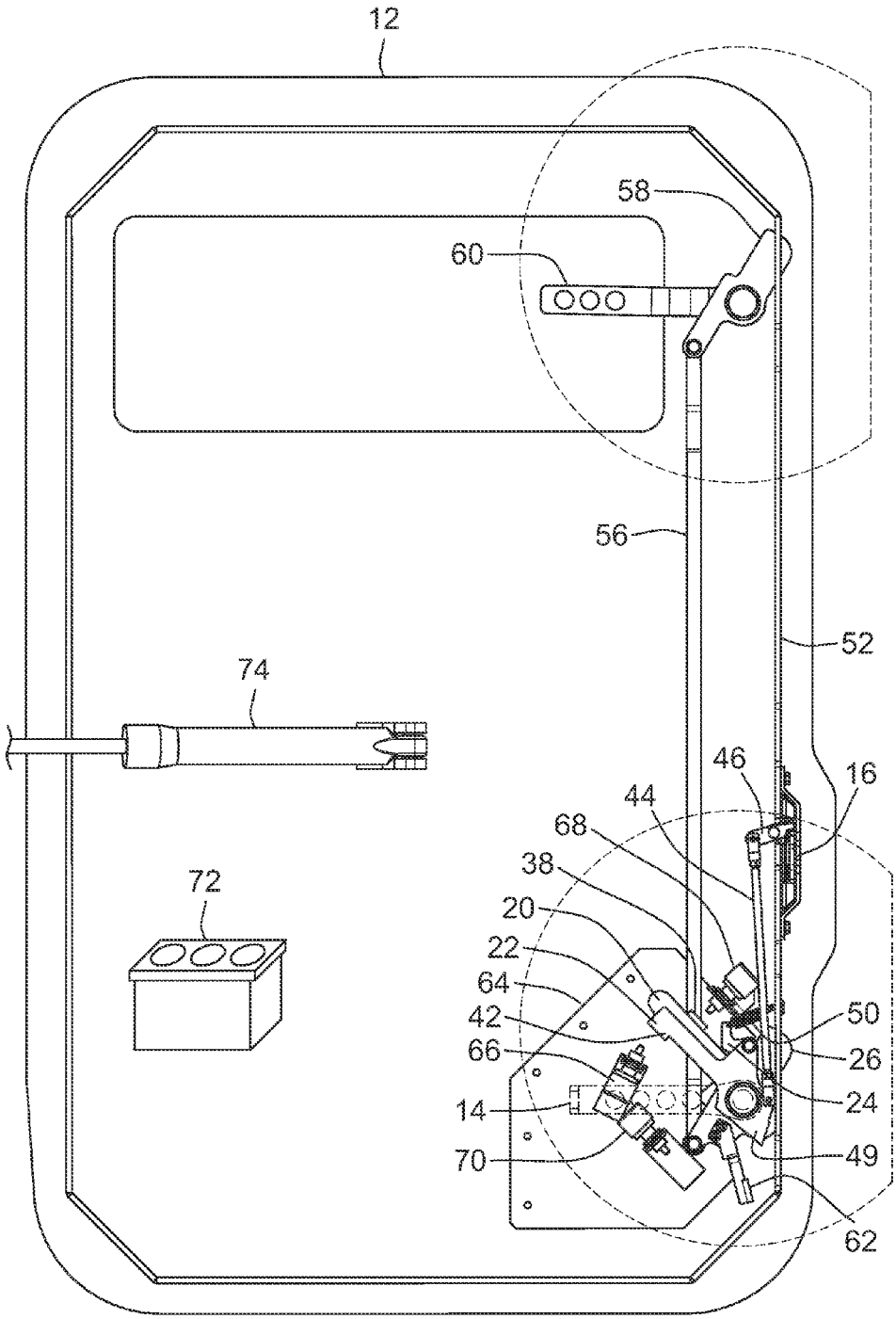
FIG. 2 is a side view of an example vehicle door with an installed vehicle door switch actuation system in its neutral position.

Referring now to FIG. 2, an example system 10 is shown installed on a closed vehicle door 12 with the system in its neutral state. Neither the exterior handle 14 nor interior handle 60 have been pushed or pulled in any direction. The open switch 66, close switch 68, and lockout switch 70 are not activated, and the upper combat latch 58 and lower combat latch 26 are not engaged. The primary arm 20, secondary arm 22, tertiary arm 24, and lockout arm 62 are in neutral positions and not rotated in any direction. Further, the combat latch rod 56 and the door latch rod 44 are in neutral positions, and the door latch 46 is ready to engage the door opening mechanism 16. Both the second spring 50 and the first spring 40 are set in a preloaded state meaning the first spring and second spring are in a slightly stretched position.

Figure 3A:
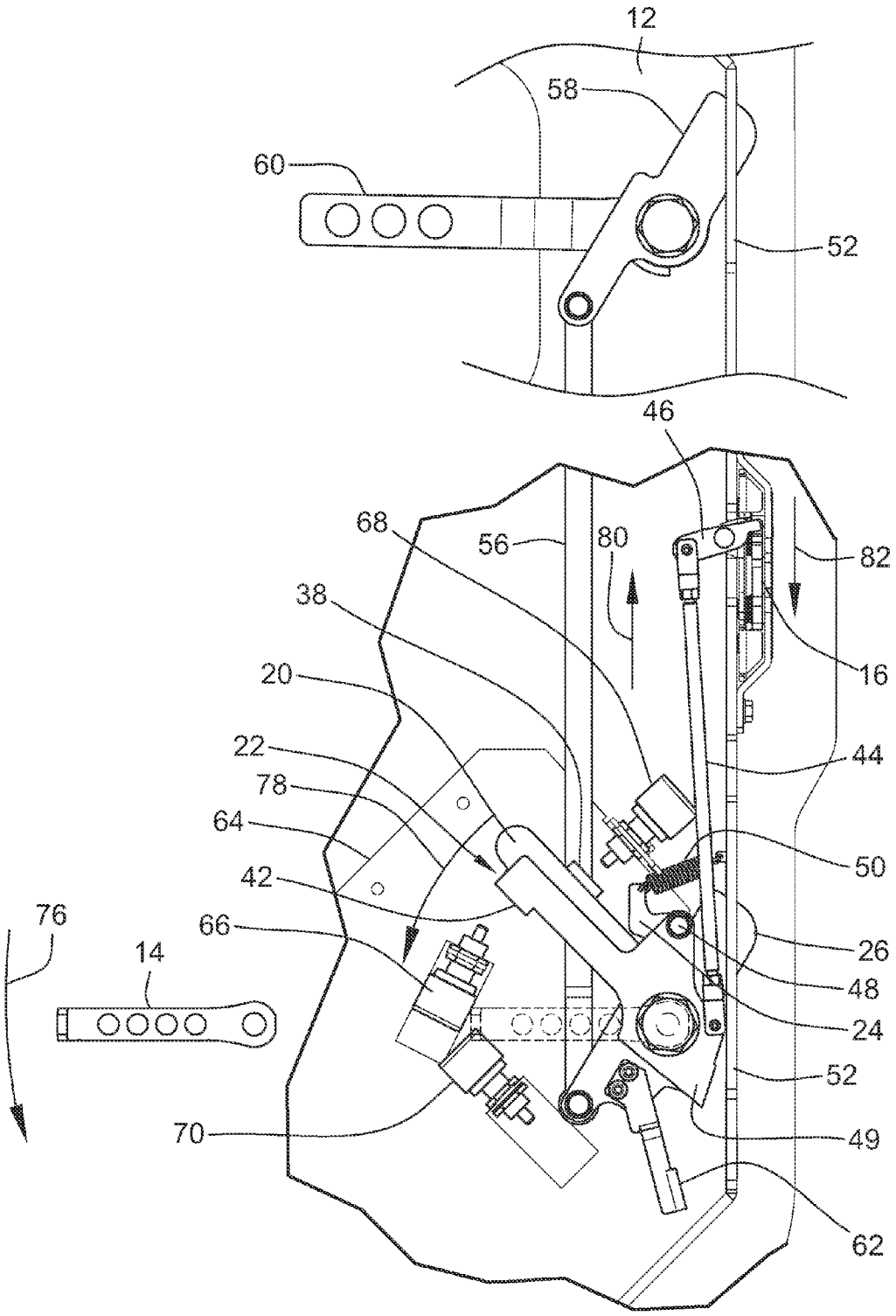
FIG. 3A is a side view of an example vehicle door switch actuation system in an initial position before an exterior handle is pulled down.

In FIG. 3A, an initial position of the example system 10 in the first mode of operation—opening the vehicle door from the outside with the exterior handle 14—is shown. The arrows 76, 78, 80, 82 indicate the direction of movement of the components of the example system 10 in response to rotation of the exterior handle 14 to an open door position. In this mode of operation, the exterior handle is pushed down, as indicated by arrow 76, which rotates the shaft 18 counter-clockwise. As the shaft 18 rotates counter-clockwise, the primary arm 20 also rotates counter-clockwise and presses against the secondary arm 22 rotating counter-clockwise as well, as indicated by arrow 78.

As the secondary arm 22 rotates counter-clockwise, it causes three other components to move. Because the secondary arm 22 is connected to the tertiary arm 24 by way of the bolt 48, as the secondary arm rotates counter-clockwise, the tertiary arm 24 rotates counter-clockwise. As the tertiary arm 48 rotates counter-clockwise, it extends the second spring 50 to a stretched position. The secondary arm 22 also pushes the door latch rod 44 upwards, as indicated by arrow 80, which pushes the door latch 46 downward to engage the door opening mechanism 16, as indicated by arrow 82. As the door latch 46 moves down, it releases the vehicle door 12 allowing it to open. Further, the finger 42 of the secondary arm 22 engages the open switch 66 as it rotates counter-clockwise. Once the open switch 66 is engaged, the powered door assist system initiates a door open operation and provides assistance in opening the vehicle door 12. When the heel 49 of the secondary arm 22 and the second heel 55 of the tertiary arm abut the frame 52 of the vehicle door 12 any further counter-clockwise rotation is restricted.

Figure 3B:
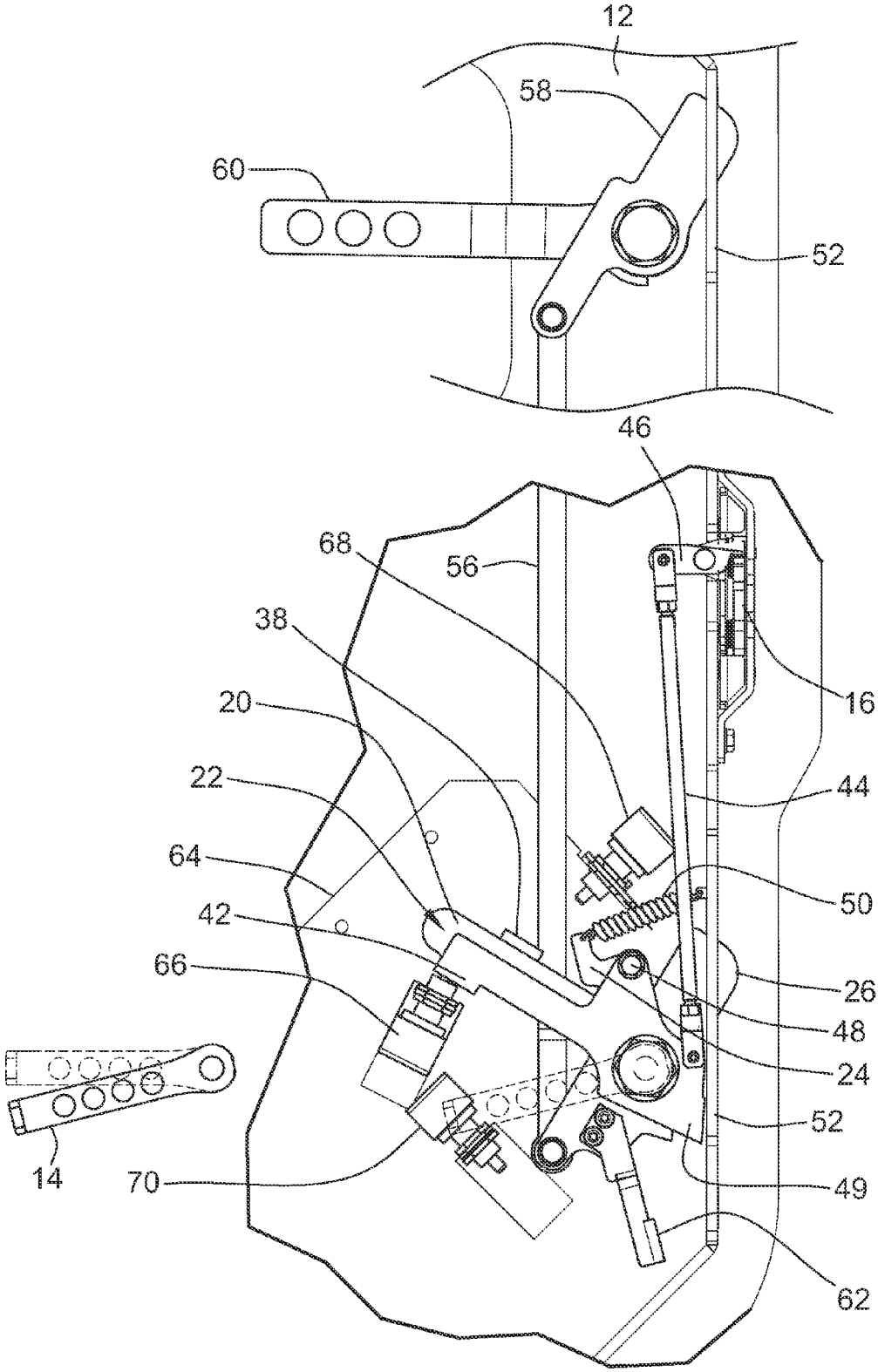
FIG. 3B is a side view of an example vehicle door switch actuation system in a final position after the exterior handle has been pulled down.

In FIG. 3B, the final position of the example system 10 in the first mode of operation—opening the vehicle door 12 from the outside with the exterior handle 14—is shown. The exterior handle 14 has been pushed down, and the primary arm 20 has rotated counter-clockwise pushing the secondary arm 22 counter-clockwise. The heel 49 of the secondary arm 22 and the second heel 55 (FIG. 1) of the tertiary arm 24 abut the frame 52 of the vehicle door 12 preventing any further counter-clockwise rotation. The secondary arm 22 is in a rotated position and the finger 42 of the secondary arm engages the open switch 66. The secondary arm 22 has also drawn the tertiary arm 24 counter-clockwise, which has extended the second spring 50 to a stretched position. Further, the secondary arm 22 has pushed the door latch rod 44 upwards, and the door latch rod has pushed the door latch 46 downward to engage the door opening mechanism 16. In the final position, the door opening mechanism 16 has released the door, and the powered door assist system is receiving a signal from the open switch 66 to initiate an open door operation and provide assistance in opening the vehicle door 12.

Releasing the exterior handle 14 may return the components of the system 10 to neutral positions. The second spring 50 connected to the tertiary arm 24 will retract and rotate the tertiary arm clockwise to a neutral position. The tertiary arm 24 arrives at a neutral position when the first heel 54 of the tertiary arm abuts the frame 52 of the vehicle door 12 preventing the tertiary arm from rotating any further. As the tertiary arm 24 rotates clockwise, it draws the secondary arm 22 to rotate clockwise as well by way of the bolt 48 connecting the components. The finger 42 of the secondary arm 22 will disengage the open switch 66 as the secondary arm rotates clockwise. Further, as the secondary arm 22 returns to a neutral position, it will push the primary arm 20 in a clockwise direction back to a neutral position as well. The secondary arm 22 and primary arm 20 also arrive at neutral positions when the first heel 54 of the tertiary arm 24 abuts the frame 52 of the vehicle door 12 preventing further clockwise rotation.

The rotation of the primary arm 20 to a neutral position will also return the exterior handle 14 to a neutral position as well. Because the primary arm 20 is meshed to the shaft 18 by way of the squared-shaped hole 28 in the primary arm and the square-shaped end 30 of the shaft, as the primary arm rotates clockwise, the shaft will also rotate clockwise causing the exterior handle 14 to rotate clockwise to a neutral position. Further, as the secondary arm 22 rotates clockwise, it pulls the door latch rod 44 downward to a neutral position, which pulls the door latch 46 up to a neutral position. As the secondary arm rotates clockwise, it disengages the open switch 66 ceasing any assistance from the powered door assist system.

Figure 4A:
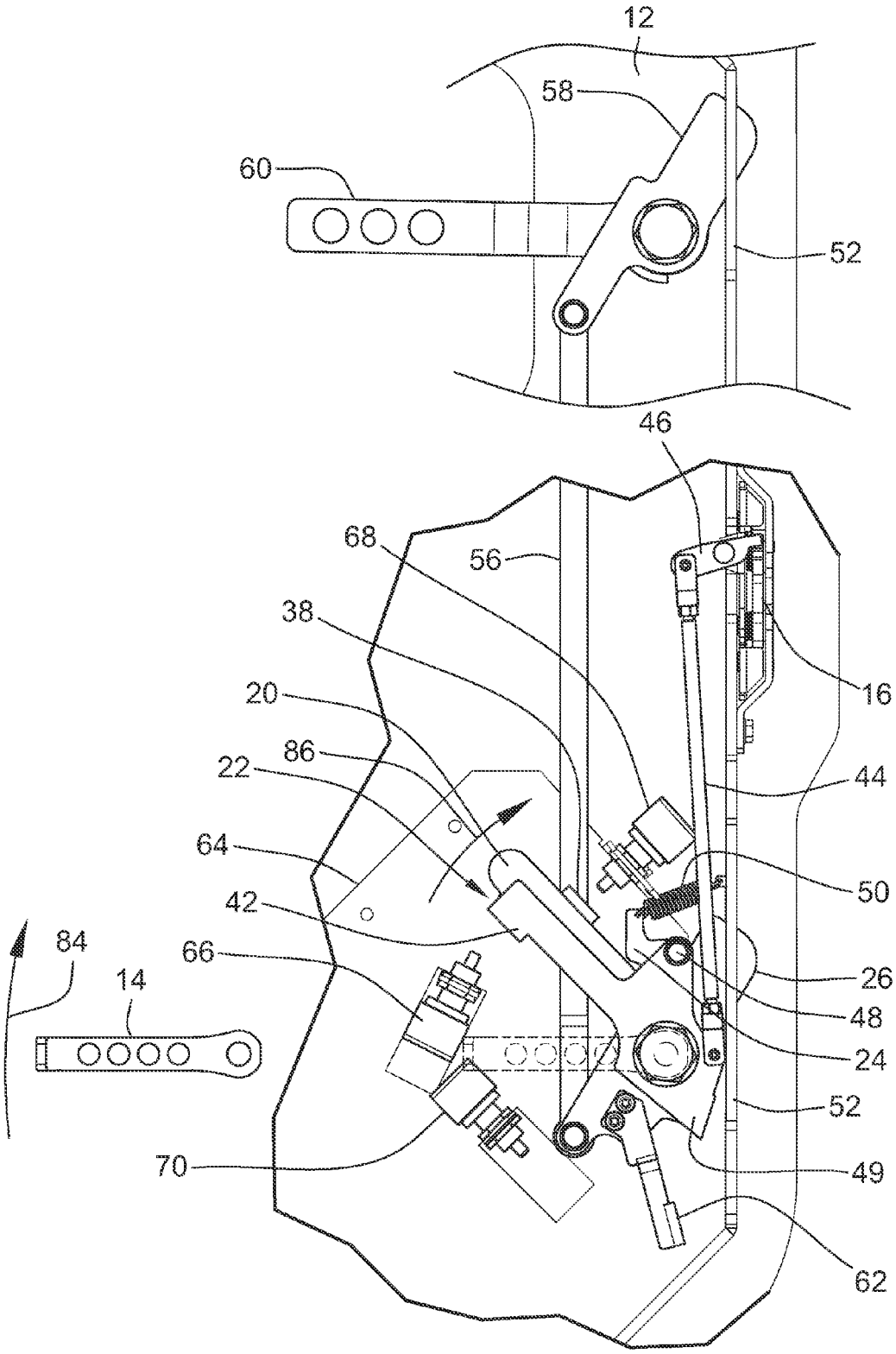
FIG. 4A is a side view of an example vehicle door switch actuation system in an initial position before an exterior handle is pulled up.

Referring now to FIG. 4A, the initial position of an example system 10 in the second mode of operation—closing the vehicle door 12 from the outside with the exterior handle 14—is shown. Arrows 84, 86 indicate the direction of movement of the components in response to rotation of the exterior handle 14 to a closed door position. In this mode of operation, the exterior handle 14 is pulled upward, as indicated by arrow 84, which rotates the shaft 18 clockwise. As the shaft 18 rotates clockwise, the primary arm 20 rotates clockwise as well, as indicated by arrow 86. As the primary arm 20 rotates clockwise, the first spring 40 connecting the primary arm to the secondary arm 22 extends to a stretched position.

The first heel 54 of the tertiary arm 24, abutting the frame 52 of the vehicle door 12, prevents the secondary arm 22 from rotating clockwise with the primary arm 20. The first heel 54 prevents the tertiary arm 24, and thus the secondary arm 22, from any further clockwise rotation. Thus, only the primary arm 20 rotates clockwise when the shaft 18 rotates clockwise; the secondary arm 22 and tertiary arm 24 remain in neutral positions. As the primary arm 20 rotates clockwise, the finger 38 of the primary arm engages the close switch 68. Once the close switch 68 is engaged, the powered door assist system initiates a close door operation and provides assistance in closing the vehicle door 12. The close switch 68 is also used to restrict further clockwise rotation of the primary arm 20, the finger 38 of which presses against the close switch to engage it. Thus, the close switch 68 prevents further clockwise rotation of the primary arm 20 by obstructing the path of the primary arm.

Figure 4B:
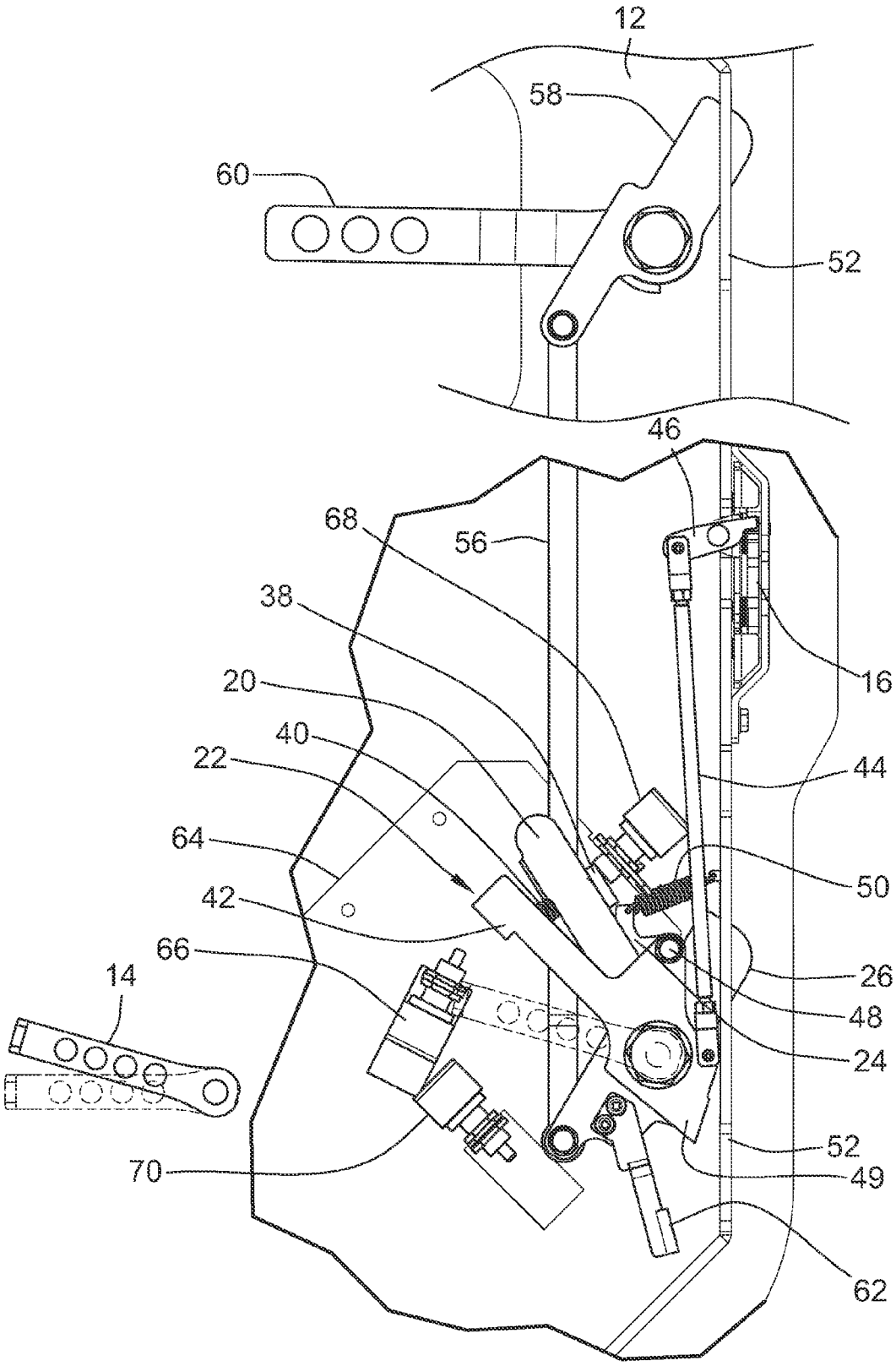
FIG. 4B is a side view of an example vehicle door switch actuation system in a final position after the exterior handle is pulled up.

In FIG. 4B, the final position of the example system 10 in the second mode of operation—closing the vehicle door 12 from the outside with the exterior handle 14—is shown. The exterior handle 14 has been pulled upwards, and the shaft has rotated clockwise. The primary arm 20 has also rotated clockwise and the finger 38 of the primary arm engages the close switch 68. The first spring 40 connecting the primary arm 20 and secondary arm 22 is extended to a stretched position. In this final position, the powered door assist system is receiving a signal from the close switch 68 to initiate a door close operation and provide assistance in closing the vehicle door 12.

Releasing the exterior handle 14 may return the components of the system 10 to neutral positions. Once the exterior handle 14 is released, the first spring 40 connected between the primary arm 20 and secondary arm 22 will retract and return the primary arm to a neutral position. As the first spring 40 retracts, the primary arm 20 will rotate counter-clockwise causing the shaft 18 to rotate counter-clockwise as well. As the shaft 18 rotates, the exterior handle 14 rotates counter-clockwise returning to a neutral position as well. Further, as the primary arm 20 rotates and returns to a neutral position, the finger 38 of the primary arm disengages the close switch 68 ceasing any assistance from the powered door assist system.

Figure 5A:
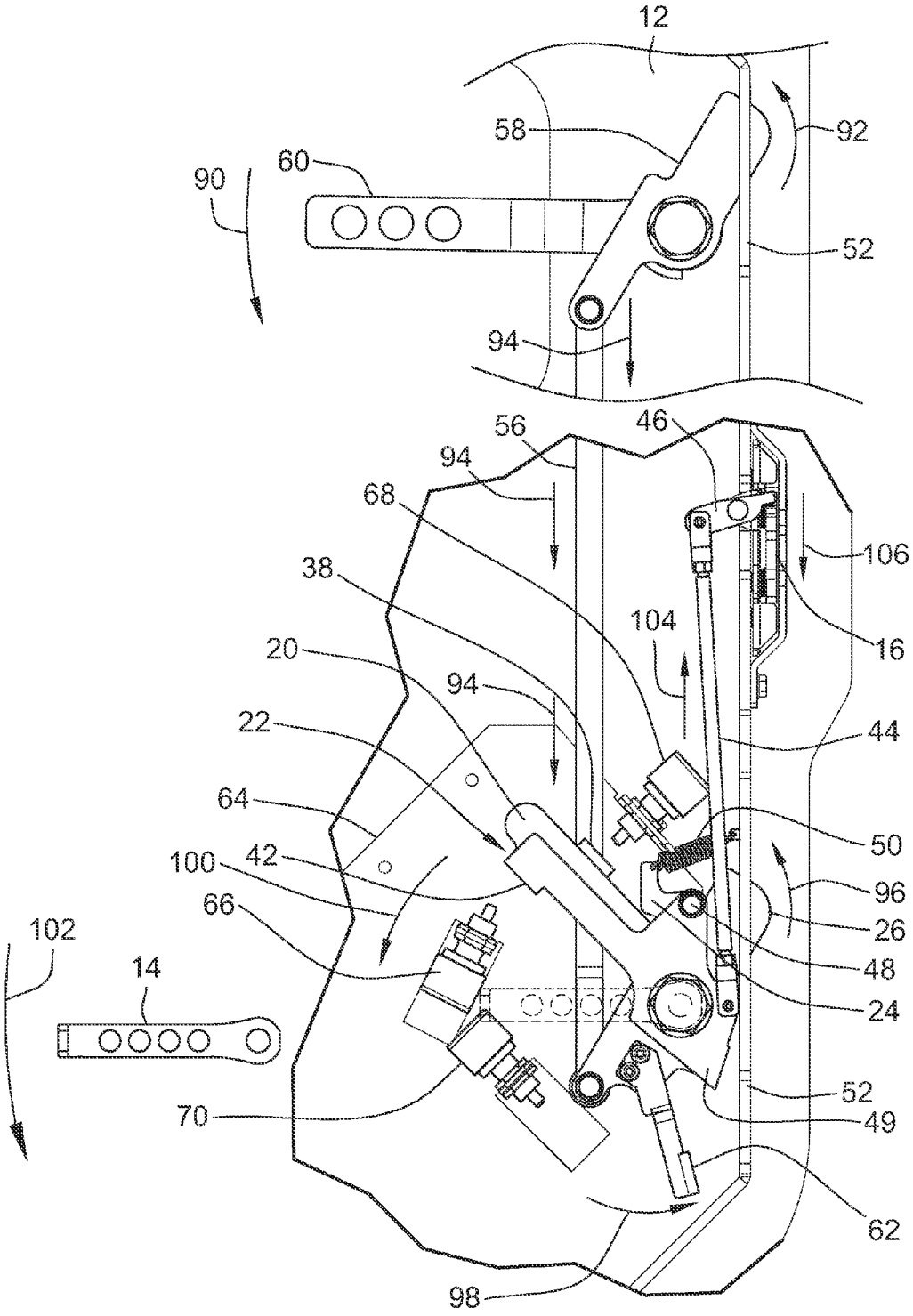
FIG. 5A is a side view of an example vehicle door switch actuation system in an initial position before an interior handle is pulled down.

Now referring to FIG. 5A, the initial position of the exemplary vehicle door switch actuation system 10 in the third mode of operation—opening the vehicle door 12 from the inside with the interior handle 60—is shown. Arrows 90, 92, 94, 96, 98, 100, 102, 104, 106 indicate the direction of movement of the components in response to movement of the interior handle to an open position. In this mode of operation, the interior handle 60 is pulled down past the neutral position, as indicated by arrow 90. As the interior handle 60 is pulled down, the upper combat latch 58 rotates counter-clockwise, as indicated by arrow 92, which pushes the combat latch rod 56 downward, as indicated by arrow 94. As the combat latch rod 56 moves down, it pushes down on the end of the lower combat latch 26 causing the lower combat latch to rotate counter-clockwise as well, as indicated by arrow 96. Because the lockout arm 62 is mounted to the lower combat latch 26, as the lower combat latch rotates counter-clockwise, the lockout arm rotates counter-clockwise as well beyond its neutral position, as indicated by arrow 98.

In the example system 10 of FIG. 5A, the lower combat latch 26 is positioned between the secondary arm 22 and the tertiary arm 24 with the connecting bolt 48 extending above and across the width of the lower combat latch. As the lower combat latch 26 rotates counter-clockwise, it pushes against the bolt 48 that connects the secondary arm 22 to the tertiary arm 24. Thus, the counter-clockwise rotation of the lower combat latch 26 causes the secondary arm 22 and tertiary arm 24 to rotate counter-clockwise as well, as indicated by arrow 100. When the heel 61 (FIG. 1) of the lower combat latch 26, heel 49 of the secondary arm 22, and second heel 55 (FIG. 1) of the tertiary arm 24 abut the frame 52 of the vehicle door 12, further counter-clockwise rotation is restricted.

As the tertiary arm 26 rotates counter-clockwise, it extends the second spring 50 to a stretched position. Due to the first spring 40 between the primary arm 20 and secondary arm 22, the secondary arm draws the primary arm counter-clockwise as well as the secondary arm rotates. Further, because the primary arm 20 meshes with the shaft 18, the shaft rotates counter-clockwise as the secondary arm 22 pulls the primary arm. This counter-clockwise rotation of the shaft 18 also causes the exterior handle 14 to rotate as well, as indicated by arrow 102.

As mentioned above, when the secondary arm 22 rotates counter-clockwise, it causes the door latch rod 44 to move upward, as indicated by arrow 104. As the door latch rod 44 moves upward, as indicated by arrow 104, it pushes the door latch 46 downward to engage the door opening mechanism 16, as indicated by arrow 106. Also mentioned above, the finger 42 of the secondary arm 22 engages the open switch 66 as the secondary arm rotates counter-clockwise. Once the open switch 66 is engaged, the powered door assist system initiates an open door operation and provides assistance in opening the vehicle door 12.

Figure 5B:
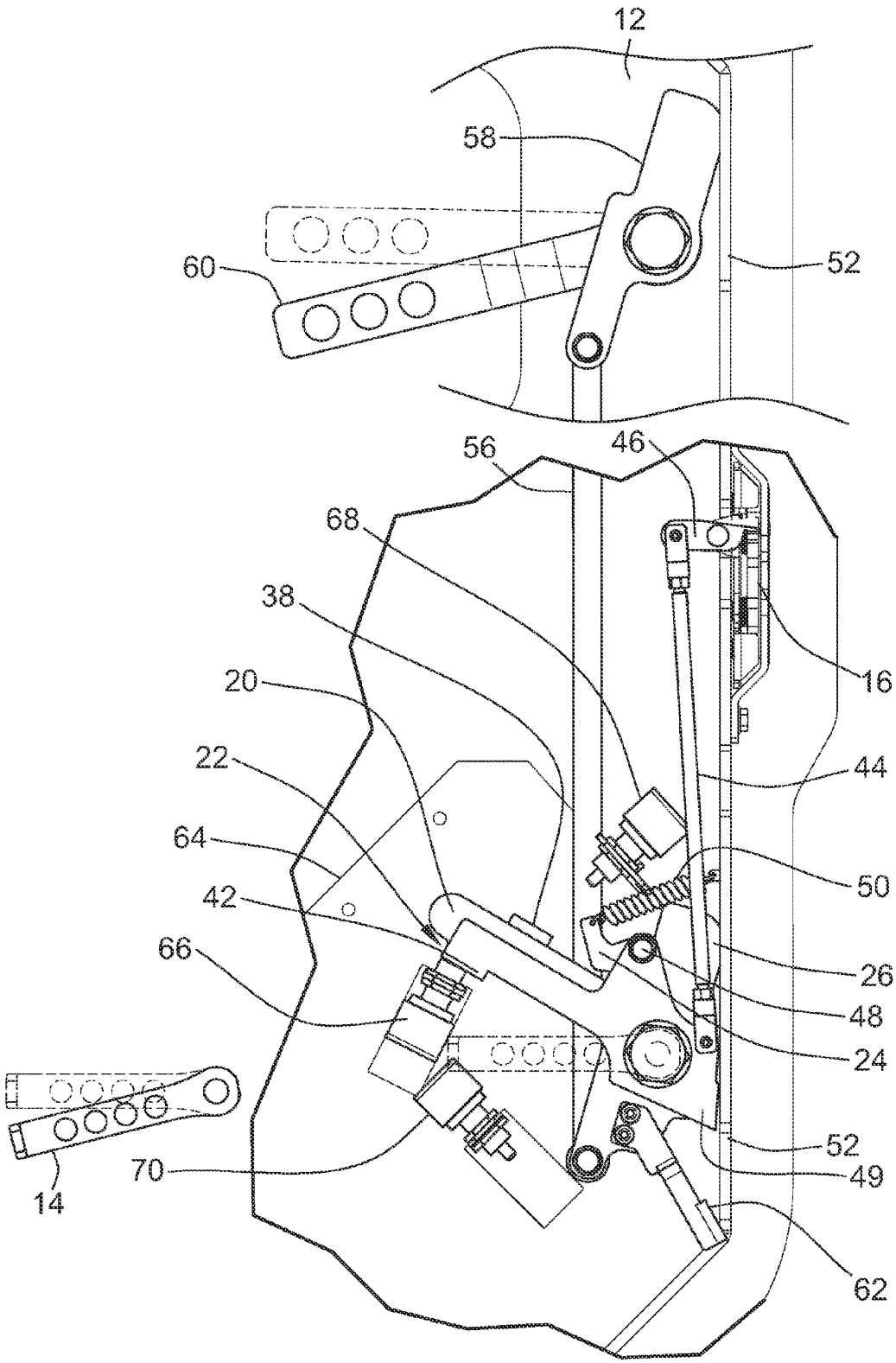
FIG. 5B is a side view of an example vehicle door switch actuation system in a final position after the interior handle is pulled down.

In FIG. 5B, the final position of the example system 10 in the third mode of operation—opening the vehicle door 12 from the inside with the interior handle 60—is shown. The interior handle 60 has been pulled down past the neutral position. The upper combat latch 58 has rotated counter-clockwise, and the combat latch rod 56 has been pushed down rotating the lower combat latch 26 counter-clockwise as well. The lower combat latch 26 is pressed against the bolt 48 connecting the secondary arm 22 and the tertiary arm 24. Both the secondary arm 22 and tertiary arm 24 have rotated counter-clockwise due to the force on the bolt 48 from the counter-clockwise rotation of the lower combat latch 26. The heel 61 (FIG. 1) of the lower combat latch, heel 49 of the secondary arm 22, and the second heel 55 of the tertiary arm 24 (FIG. 1) abut the frame 52 of the vehicle door 12 preventing any further counter-clockwise rotation.

The finger 42 of the secondary arm 22 also engages the open switch 66, has pulled the primary arm 20 counter-clockwise, and has pushed the door latch rod 44 upwards. The door latch rod 44 has pushed the door latch 46 downward to engage the door opening mechanism 16. Further, the tertiary arm 24 has extended the second spring 50 to a stretched position. In this final position, the door opening mechanism 16 has released the door, and the powered door assist system is receiving a signal from the open switch 66 to initiate an open door operation and provide assistance in opening the vehicle door 12.

Releasing the interior handle 60 to a neutral position may allow the components of the example system 10 to return to neutral positions. When the interior handle 60 is released, the second spring 50 will retract to its preloaded state. As the second spring 50 retracts, the tertiary arm 24 rotates clockwise also rotating the secondary arm 22 and the bolt 48 connected between them clockwise as well. As the bolt 48 rotates clockwise, it pushes against the lower combat latch 26 rotating the lower combat latch clockwise to a neutral position as well. As the lower combat latch 26 rotates clockwise to a neutral position, it will push up on the combat latch rod 56, which will rotate the interior handle 60 and the upper combat latch 58 back to a neutral position as well. Further, rotation of the lower combat latch 26 back to a neutral position will also rotate the lockout aim 62 counter-clockwise back to a neutral position.

Further, once the lower combat latch 26 no longer pushes on the bolt 48, the second spring 50 connecting the tertiary arm 24 to the frame 52 of the vehicle door 12 will retract. As the second spring 50 retracts, it rotates the tertiary arm clockwise back to a neutral position. Again, the tertiary arm 24 arrives at a neutral position when the first heel 54 of the tertiary arm abuts the frame 52 of the vehicle door 12 preventing it from rotating further. As the tertiary arm returns to a neutral position, the bolt 48 causes the secondary arm 22, and accordingly the primary arm 20, to rotate clockwise to a neutral position as well. Moreover, as the secondary arm 22 rotates clockwise, it pulls the door latch rod 44 downward, which pulls the door latch 46 up to a neutral position. Furthermore, as the secondary arm 22 rotates clockwise, the finger 42 of the secondary arm disengages the open switch 66, which ceases any assistance from the powered door assist system.

Figure 6A:
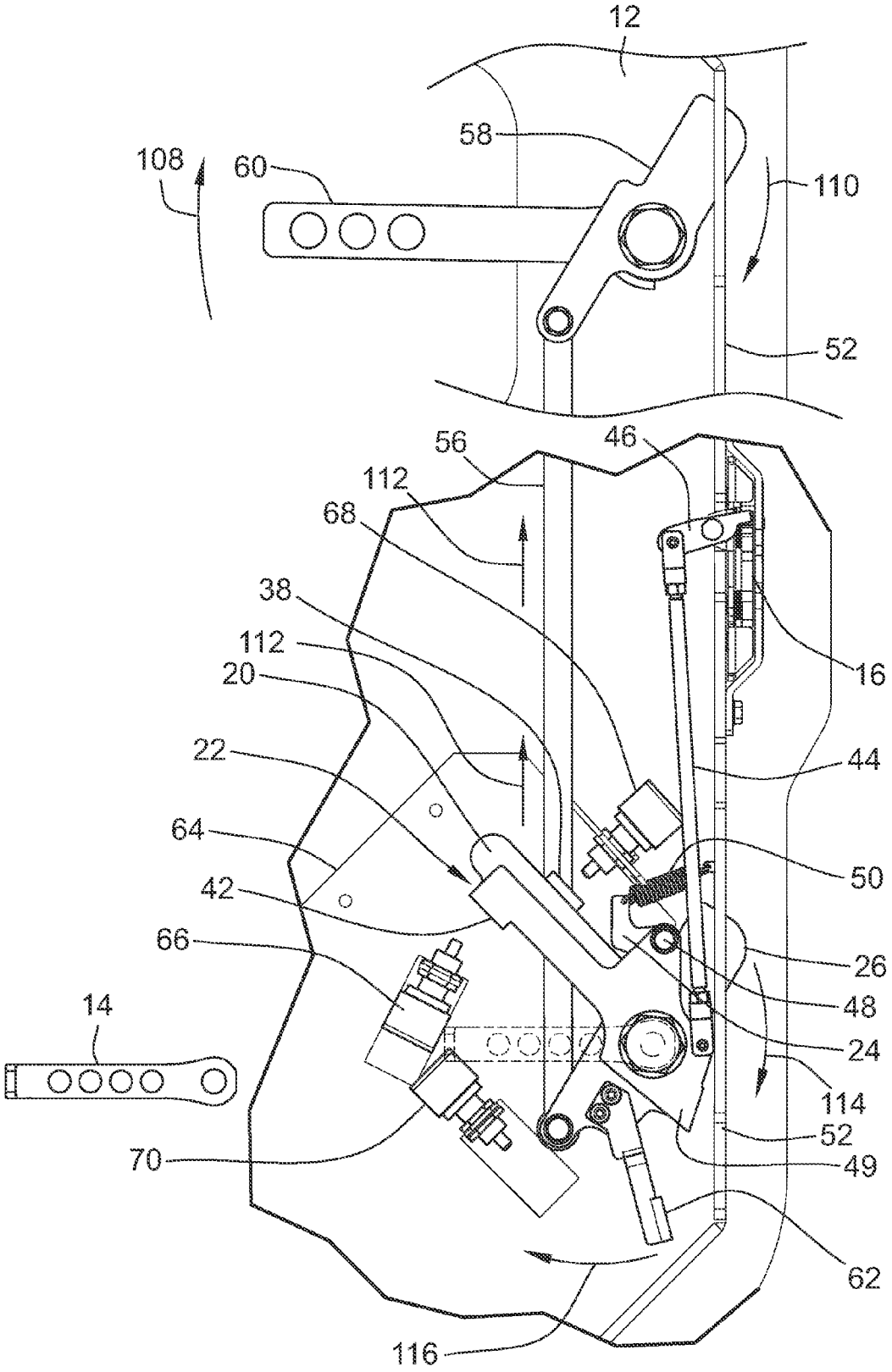
FIG. 6A is a side view of an example vehicle door switch actuation system in an initial position before an interior handle is pushed up.

Referring now to FIG. 6A, the initial position of the fourth mode of operation—engaging the combat latches 26, 58—is shown. In this mode of operation, the combat latches 26, 58 are engaged to securely close and lock the vehicle door, and instruct the powered door assist system to ignore any commands to open the door. In this example system 10 of FIG. 6A, arrows 108, 110, 112, 114, 116 indicate the direction of movement of the components in response to movement of the interior handle 60 to a lockout position. The interior handle 60 is pushed up beyond the neutral position, as indicated by arrow 108, which rotates the upper combat latch clockwise into the corresponding slot 63 (FIG. 1), as indicated by arrow 110. As the upper combat latch 58 rotates clockwise, it pulls the combat latch rod 56 upwards, as indicated by arrow 112, which pulls up on the end of the lower combat latch 26 also causing it to rotate clockwise into the corresponding slot 63 (FIG. 1), as indicated by arrow 114. As the lower combat latch 26 rotates clockwise, the lockout arm 62 mounted to the lower combat latch also rotates clockwise, as indicated by arrow 116. As the lockout arm 62 rotates clockwise, it engages the lockout switch 70. Once the lockout switch 70 is engaged, it cuts the circuit between the powered door assist system and the open switch 66 and the close switch 68 preventing activation of the powered door assist system. When the combat latches 26, 58 abut the bottom of each respective slot 63 (FIG. 1), further clockwise rotation is restricted.

Figure 6B:
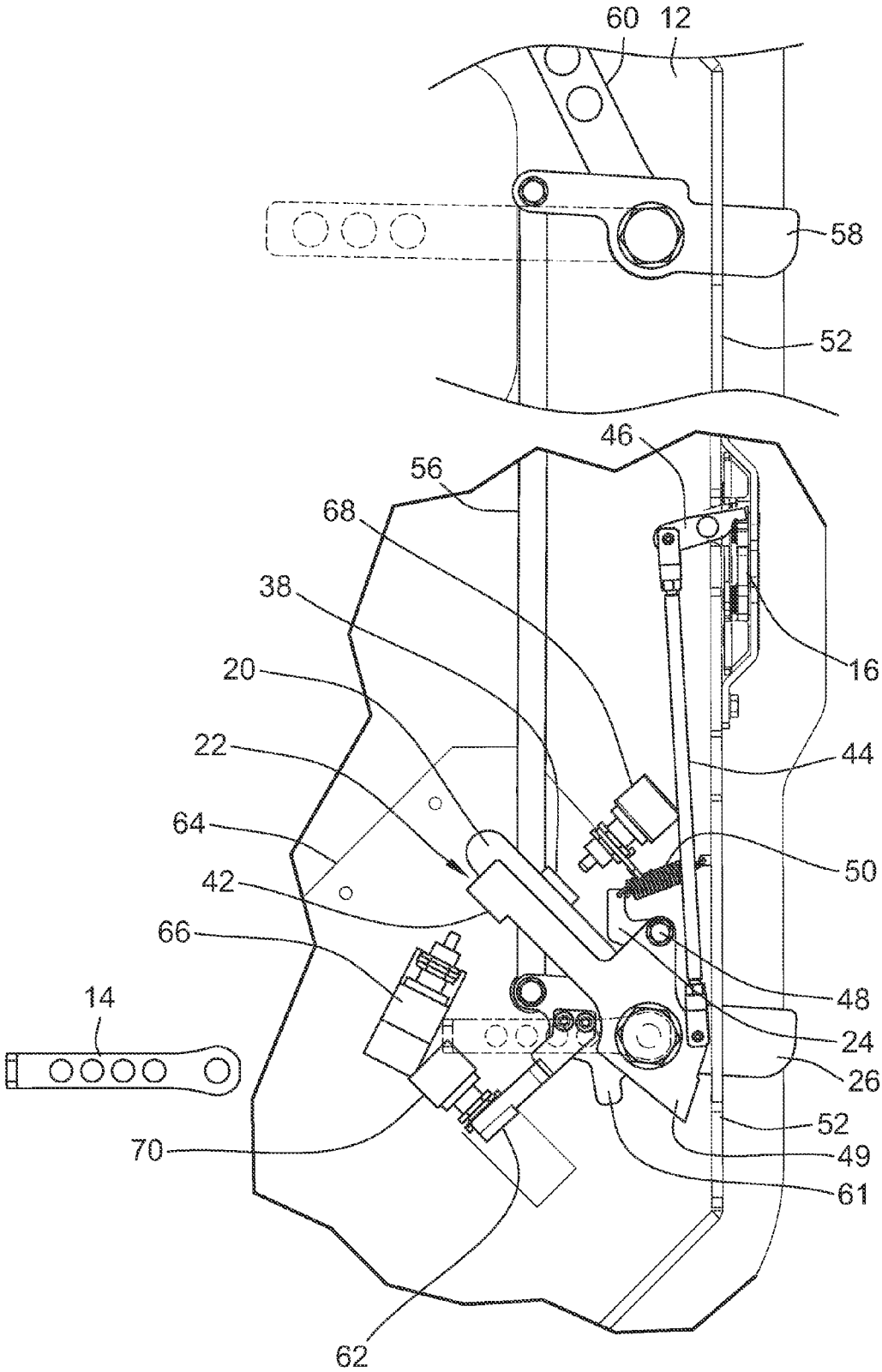
FIG. 6B is a side view of an example vehicle door switch actuation system in a final position after the interior handle is pushed up.

In FIG. 6B, the final position of the fourth mode of operation—engaging the combat latches 26, 58—is shown. The interior handle 60 has been pushed up beyond its neutral position. The upper combat latch 58 has rotated clockwise into place to secure the vehicle door 12 at the top of the door. The combat latch rod 56 has pulled up the end of the lower combat latch 26, and the lower combat latch has also rotated clockwise into place to secure the vehicle door 12 at the bottom. Each combat latch 26, 58 abuts the bottom of each respective slot 63 (FIG. 1), preventing any further clockwise rotation. Further, the lockout arm 62 has rotated clockwise and is engaging the lockout switch 70. Thus, the controller of the powered door assist system is prevented from initiating an open door or close door operation.

Returning the interior handle 60 to a neutral position may allow the components of the system 10 to return to neutral positions. Pulling down on the interior handle 60 to return it to a neutral position disengages the upper combat latch 58 rotating it counter-clockwise. As the interior handle 60 is pulled down, the combat latch rod 56 moves downward and pushes down on the end of the lower combat latch 26. Thus, the lower combat latch 26 also disengages and rotates counter-clockwise as well. As the lower combat latch 26 rotates counter-clockwise, the lockout aim 62 rotates counter-clockwise and disengages the lockout switch 70. Once the lockout switch 70 is disengaged, the powered door assist system will accept commands to open the vehicle door 12 once more.

It should be understood that the aforementioned description discusses the movement and rotation of components of an example system installed on a right-side vehicle door. In an example system installed on a left-side vehicle door, the movement and rotation of components may be reversed. For example, elements that rotate counter-clockwise in a right-side vehicle door may rotate clockwise in a left-side vehicle door and vice versa.

The invention illustratively disclosed herein suitably may be practiced in the absence of any element, part, step, component, or ingredient, which is not Specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that the details described herein can be varied considerably without departing from the basic principles of the invention.

What is claimed is:

1. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft;

a second arm mounted to the shaft, wherein the second arm engages an open switch in response to rotation of the exterior handle to the open door position and the first arm engages a close switch in response to rotation of the exterior handle to a close door position, and wherein the second arm engages the open switch in response to movement of the interior handle to an open position.

2. The system of claim 1 wherein the open switch signals a controller to initiate an open door operation upon activation of the open switch and the close switch signals the controller to initiate a close door operation upon activation of the close switch.

3. The system of claim 1 wherein the shaft rotates the first arm when the exterior handle is moved to the open door position and the first arm contacts the second arm causing the second arm to rotate and engage the open switch.

4. The system of claim 3 wherein the first arm is meshed to the shaft such that the first arm rotates as the shaft rotates, and wherein the second arm is mounted to the shaft such that it does not rotate as the shaft rotates.

5. The system of claim 4 wherein the first arm has a square-shaped portion that meshes with a corresponding square-shaped portion of the shaft, and wherein the second arm has a round hole such that the shaft passes through the round hole.

6. The system of claim 3 further comprising a rod attached to the second arm and to the door latch component, wherein the mechanical door opening mechanism is adapted to release the vehicle door in response to rotation of the second arm.

7. The system of claim 1 wherein the first arm is mounted to the shaft such that the first arm rotates in one direction as the exterior handle is moved to the close door position.

8. The system of claim 7 wherein the first arm has a square-shaped portion that meshes with a corresponding square-shaped portion of the shaft.

9. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft;

a second arm mounted to the shaft, wherein the second arm engages an open switch in response to rotation of the exterior handle to the open door position and the first arm engages a close switch in response to rotation of the exterior handle to a close door position, and wherein the second arm engages the open switch in response to movement of the interior handle to an open position;

a third arm mounted to the shaft, the third arm being mechanically coupled to the first arm and the second arm; and a spring connected to the third arm and to a frame of the vehicle door such that the first arm returns to a neutral position upon release of the exterior handle from the open door position and the second arm returns to the neutral position upon release of the exterior handle from the open door position.

10. The system of claim 9 further comprising a fourth arm secured to a rotatable component, the rotatable component mounted to the shaft such that in response to rotation of the rotatable component, the fourth arm engages a lockout switch, wherein the lockout switch is adapted to prevent activation of a controller by the open switch or the close switch.

11. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft; and a second arm mounted to the shaft, wherein the second arm engages an open switch in response to rotation of the exterior handle to the open door position and the first arm engages a close switch in response to rotation of the exterior handle to a close door position, wherein the second arm engages the open switch in response to movement of the interior handle to an open position, and wherein the first arm and the second arm are mounted to the shaft such that both the first arm and second arm rotate in response to rotation of the exterior handle to the open door position and only the first arm rotates in response to rotation of the exterior handle to the close door position.

12. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft;

a second arm mounted to the shaft, wherein the second arm engages an open switch in response to rotation of the exterior handle to the open door position and the first arm engages a close switch in response to rotation of the exterior handle to a close door position, and wherein the second arm engages the open switch in response to movement of the interior handle to an open position; and wherein the shaft rotates the first arm when the exterior handle is moved to the open door position and the first arm contacts the second arm causing the second arm to rotate and engage the open switch, and wherein the second arm has a heel that abuts a frame of the vehicle door to limit the range of rotation of the second arm.

13. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft;

a second arm mounted to the shaft, wherein the second arm engages an open switch in response to rotation of the exterior handle to the open door position and the first arm engages a close switch in response to rotation of the exterior handle to a close door position, and wherein the second arm engages the open switch in response to movement of the interior handle to an open position;

wherein the shaft rotates the first arm when the exterior handle is moved to the open door position and the first arm contacts the second arm causing the second arm to rotate and engage the open switch, and wherein the second arm is connected to a third arm; and a spring, wherein one end of the spring is connected to the third arm and another end of the spring is connected to a frame of the vehicle door such that the spring expands when the third arm rotates in one direction.

14. The system of claim 13 wherein the spring retracts to rotate the second arm and the third arm in an opposite direction upon release of the exterior handle from the open door position.

15. The system of claim 14 wherein the second arm pushes the first arm in the opposite direction as the second arm rotates in the opposite direction.

16. The system of claim 14 wherein the third arm includes a heel that abuts the frame of the vehicle door as the third arm rotates in the opposite direction to limit the range of rotation of the third arm.

17. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft;

a second arm mounted to the shaft, wherein the second arm engages an open switch in response to rotation of the exterior handle to the open door position and the first arm engages a close switch in response to rotation of the exterior handle to a close door position, wherein the second arm engages the open switch in response to movement of the interior handle to an open position, and wherein the first arm is mounted to the shaft such that the first arm rotates in one direction as the exterior handle is moved to the closed door position; and wherein the first arm is connected to the second arm, the second arm is mounted on the shaft such that the second arm remains stationary as the first arm rotates in the one direction.

18. The system of claim 17 further comprising a spring connected between the first arm and the second arm, wherein the spring extends as the first arm rotates in the one direction and the spring retracts rotating the first arm in an opposite direction upon release of the exterior handle from the close door position.

19. The system of claim 18 wherein the second arm has a round hole such that the shaft passes through the round hole.

20. The system of claim 18 wherein the second arm is connected to a third arm, the third arm has a heel that abuts a frame of the vehicle door to prevent rotation of the second arm and the third arm in the one direction.

21. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft; and a second arm mounted to the shaft, wherein the second arm engages an open switch in response to rotation of the exterior handle to the open door position and the first arm engages a close switch in response to rotation of the exterior handle to a close door position, wherein the second arm engages the open switch in response to movement of the interior handle to an open position, and wherein the interior handle is mechanically coupled to a rotatable component mounted to the shaft such that movement of the interior handle to the open position rotates the rotatable component causing the second arm to rotate and engage the open switch.

22. The system of claim 21 wherein the second arm is secured to a rod connected to the door latch component such that rotation of the second arm moves the rod and the door latch component.

23. The system of claim 21 further comprising a bolt connected between the second arm and a third arm mounted to the shaft, the rotatable component pushes against the bolt causing rotation of the second arm and the third arm in one direction in response to movement of the interior handle to the open position.

24. The system of claim 23 further comprising a spring, and wherein one end of the spring is connected to the third arm and another end of the spring is connected to a frame of the vehicle door such that the spring expands when the second and third arms rotate in the one direction.

25. The system of claim 24 wherein the spring retracts rotating both the second and third arms in an opposite direction upon release of the interior handle from the open position.

26. The system of claim 25 wherein the third arm includes a heel that abuts the frame of the vehicle door as the third arm rotates in the opposite direction to limit the range of rotation of the third arm.

27. The system of claim 21 further comprising a rod connected to the interior handle and to the rotatable component such that movement of the interior handle to the open position moves the rod and rotates the rotatable component in one direction.

28. The system of claim 27 wherein the rotatable component includes a heel that abuts a frame of the vehicle door as the rotatable component rotates in the one direction to limit the range of rotation of the rotatable component.

29. A system for opening and closing a vehicle door, comprising:

an interior handle and an exterior handle, the exterior handle mounted on an exterior of the vehicle door;

the exterior handle mechanically coupled with a rotatable shaft, the shaft being mechanically coupled with a door latch component, the door latch component engages a mechanical door opening mechanism adapted to release the vehicle door such that rotation of the exterior handle to an open door position moves the door latch component to release the vehicle door;

a first arm mounted to the shaft; and a second arm mounted to the shaft, wherein the second arm engages an open switch in response to rotation of the exterior handle to the open door position and the first arm engages a close switch in response to rotation of the exterior handle to a close door position, wherein the second arm engages the open switch in response to movement of the interior handle to an open position, and wherein the interior handle is mechanically coupled to a rotatable component mounted to the shaft, wherein movement of the rotatable component causes a lockout switch to be activated in response to movement of the interior handle to a lockout position.

30. The system of claim 29 wherein the lockout switch is adapted to create an open circuit between a controller and at least one of the open switch and the close switch.

31. The system of claim 29 wherein the lockout switch is adapted to prevent activation of a powered door assist system.

32. The system of claim 29 further comprising a rod connected to the interior handle and to the rotatable component such that movement of the interior handle to the lockout position moves the rod in an upward direction and rotates the rotatable component in one direction.

33. The system of claim 32 wherein one end of the rod is connected to another rotatable component such that the other rotatable component rotates in the one direction as the rod moves in the upward direction.

34. The system of claim 33 wherein the rotatable component and the other rotatable component rotate into corresponding slots in the frame of the vehicle door to secure the vehicle door.

35. The system of claim 29 further comprising a lockout arm secured to the rotatable component such that the lockout arm moves as the rotatable component rotates.

36. The system of claim 35 wherein the lockout arm engages the lockout switch as the rotatable component and lockout arm rotate.

* * * * *